United States Patent [19]

Leroy

[11] 4,043,166

[45] Aug. 23, 1977

[54] REMOVING CRUST OF OXIDE FROM PROFILED WIRE ROD

[75] Inventor: Jean Leroy, Hoboken-Anvers, Belgium

[73] Assignee: Metallurgie Hoboken-Overpelt, Brussels, Belgium

[21] Appl. No.: 653,569

[22] Filed: Jan. 29, 1976

Related U.S. Application Data

[63] Continuation of Ser. No. 439,811, Feb. 5, 1974, abandoned.

[30] Foreign Application Priority Data

Feb. 12, 1973 Luxembourg ..... 67008

[51] Int. Cl.[2] ..... B08B 3/02; B21B 45/02

[52] U.S. Cl. ..... 72/39; 72/45; 72/201; 134/9; 134/15; 148/11.5 C; 266/113

[58] Field of Search ..... 134/15, 17, 9, 26, 30, 134/64 R, 122 R, 199, 34; 29/81 B, 81 F; 72/39, 43, 201, 202, 45, 365, 366; 266/6 S, 113, 114; 148/156, 157, 11.5 C

[56] References Cited

U.S. PATENT DOCUMENTS

| | | | |
|---|---|---|---|
| 608,382 | 8/1898 | McMurtry | 134/122 |
| 2,140,289 | 12/1938 | Hurtt et al. | 72/43 |
| 2,357,695 | 9/1944 | Skowron | 134/17 X |
| 2,394,514 | 2/1946 | Evans et al. | 134/15 X |
| 3,323,577 | 6/1967 | Clumpner | 266/113 X |
| 3,468,362 | 9/1969 | Burkhardt et al. | 134/15 X |
| 3,543,775 | 12/1970 | Bodnar | 134/15 X |
| 3,766,763 | 10/1973 | Cofer et al. | 72/45 X |
| 3,928,090 | 12/1975 | Randerson | 148/157 X |

*Primary Examiner*—S. Leon Bashore
*Assistant Examiner*—Richard V. Fisher
*Attorney, Agent, or Firm*—Fred Philpitt

[57] ABSTRACT

Removing the crust of oxide formed on the surface of a continuously casted copper bar by projecting a liquid (water or a rolling emulsion) under pressure of between 20 and 60 atmospheres against the periphery of the bar, the flow of the liquid under pressure being less than 50 liters/minute.

10 Claims, 4 Drawing Figures

REMOVING CRUST OF OXIDE FROM PROFILED WIRE ROD

Figure 1:
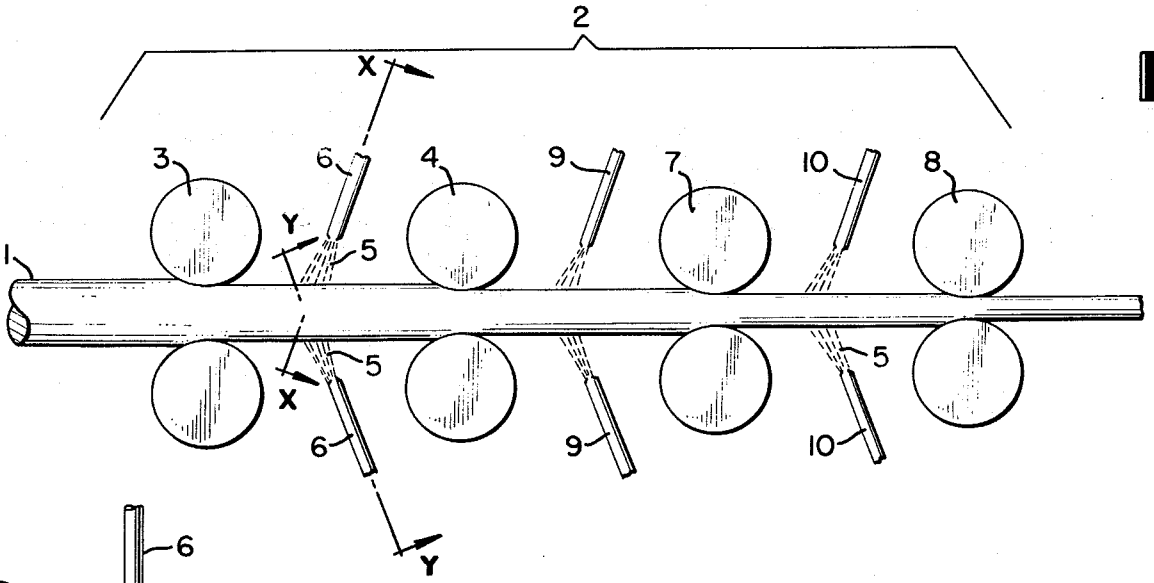

This is a continuation of application Ser. No. 439,811, filed Feb. 5, 1974, now abandoned. su A process is already known for the direct and continuous manufacture of profiled copper bars in which a copper bar is produced by continuous casting, said process involving hot rolling mill in which the bars are shaped into the desired profile. The oxides formed on the surface of the hot bar during its conveyance from the casting device to the last rolling stand are found on the bar emerging from the rolling mill as a crust strongly rooted in the underlying metal by countless incrustations of oxide due to the rolling. The removal of these oxides is only possible by a tedious pickling operation which leaves a final product with a very rough surface due to the spaces left by said incrustations. In addition to the roughness of the final product and the tedious pickling operation which it requires, the known process has also the drawback that the groovings of the rolls rapidly deteriorate owing to the abrasive action of the oxides present on the surface of the bar during the rolling operation.

It has been already proposed to avoid said drawbacks by protecting the bar in a neutral or reducing atmosphere during its entire conveyance between the casting device and its evacuation in its final form. It is however obvious that such a precaution entails very high investment and operation costs. For that reason, the said process has not been industrially used.

The present invention allows on the one hand the production by less expensive, yet effective means of a rolled product which is easy to pickle and yields a final product with a smooth surface, and on the other hand retards substantially the wear of the rolls, thus avoiding the difficulties met with in the processes already known.

The present invention relates to a process for the direct and continuous manufacture of profiled bars or wire rod, more especially of copper, in which a bar is produced by continuous casting and is conveyed while still hot to a rolling mill where the said bar is shaped into the desired profile in several passes, said process being characterized in that the crust of oxide formed on the surface of the bar is removed in one or more cleaning operations between the first rolling passes by projecting a liquid under a pressure comprised between 20 and 60 atmospheres against the periphery of the bar, the flow of said liquid being lower than 50 liters/minute per cleaning operation to avoid an appreciable cooling of the bar.

Said liquid may be water or a rolling emulsion.

The liquid may be projected on the periphery of the bar as wide flat jets, the width of which is directed perpendicularly to the longitudinal axis of the bar.

The direction of projection of said jets will preferably be such that at the evacuation side of the final product, the direction of projection will form acute angles with the advance direction of the bar. Still more preferably, said angles will be within the range of between 60° and 80°. It is advantageous to make use of two flat jets per cleaning operation, each jet striking a different half of the periphery of the bar.

It has been found that the process according to the invention yields very good results when a cleaning operation is effected after each of the first three rolling passes.

It may be advantageous from a metallurgical point of view to effect the last rolling passes at a temperature lower than that of the preceding passes. In such case, according to the invention, an abrupt cooling of the bar is provided before said last rolling passes, for it has been noted that after such a treatment the pellicle of oxides present on the surface of the bar scales off and that an additional cleaning operation is thus effected.

The bar may be abruptly cooled by conveying a liquid under high pressure around and along the bar. Such liquid may be a rolling emulsion or water.

Said pressure will preferably be higher than 5 atmospheres, for instance between 5 and 10 atmospheres. The abrupt or sudden cooling of the bar may advantageouly be effected before applying the penultimate rolling pass.

Figure 3:
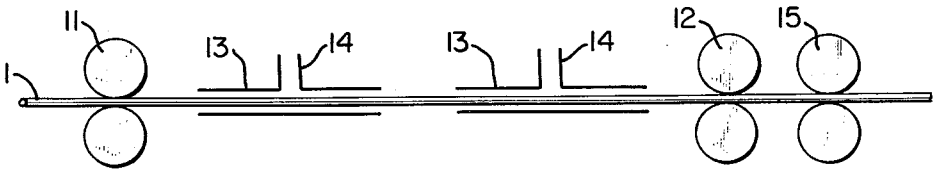
Figure 2A:
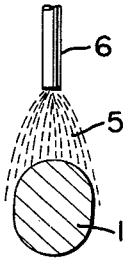
Figure 2B:
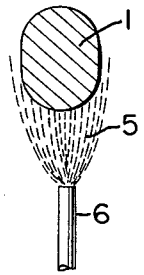

The invention will be better understood from the two following examples, which however do not limit the scope of the invention. The two examples relate to the manufacture of copper wire rod from molten copper and are illustrated by the accompanying drawing, in which FIG. 1 represents schematically a longitudinal section of the first four stands of a conventional wire rod rolling mill adapted to carry into effect the process according to the invention;

FIG. 2*a* is a sectional view, on a larger scale, along line X—X of FIG. 1;

FIG. 2*b* is a sectional view, on a larger scale, along line Y—Y of FIG. 1;

FIG. 3 represents a longitudinal section of the three last stands of a conventional wire rod rolling mill adapted to carry into effect the cooling of the rod before the two last stands according to the process of the invention.

EXAMPLE 1

In a continuous casting device known "per se" (and not illustrated), copper is cast to produce a bar 1 with a section of 5500 $mm^2$ at a rate of about 11 meters/minute, and bar 1 is directed to a wire rod mill 2 while its temperature is kept or brought by means known "per se" within the range of 850° to 870° C as this interval of temperature is particularly suited to the hot shaping of copper. The bar 1 is introduced into rolling mill 2 which is of a conventional continuous type comprising 15 stands, wherein the bar 1 is shaped into a wire rod of 8 mm diameter, while utilizing as a rolling emulsion, acting as a lubricant, an emulsion of wter and a soluble oil or a synthetic product with the same characteristics as a soluble oil.

Between the first stand 3 and the second stand 4 two jets of rolling emulsion 5 are pumped at a pressure of about 40 atmospheres and at a flow of about 22.5 liters/-minute through two spraying nozzles 6 located on both sides of the path of the bar 1, and are projected on the periphery of said bar from a distance of about 15 cm. The jet 5 produced by the spraying nozzles 6 has the form of a flattened cone having a thickness of about 2.5 mm and a width of about 150 mm near the surface of the bar 1. The spraying nozzles 6 are so directed that the width of the flattened cone of projected liquid is directed perpendicularly to the longitudinal axis of the bar 1 and the axis of said cone forms with the longitudinal axis of the bar at the second stand, an angle of 70°. The oxides which have accumulated on the surface of the bar 1, since the latter has left the casting device, are thus removed without an appreciable cooling of the bar 1.

The rolled bar 1 progressing between the second stand 4 and the third stand 7 and between the third stand 7 and the fourth stand 8 is cleaned in the same way by the nozzles 9 and 10.

The bar is further rolled without special precautions. However, the wire rod thus obtained may be pickled twice as fast, and its surface after pickling is much smoother than that of a wire rod obtained in the same plant by the prior art process, i.e. without any cleaning between the rolling passes. In addition, the average lifetime of the groovings of the rolls is increased by 20%.

In the above mentioned example the temperature of the bar was about 800° C throughout the entire rolling mill, thus yielding a very ductile wire rod suitable for further wire drawing without intermediate annealings.

EXAMPLE 2

This example relates to the manufacture of a copper wire rod having better annealing properties and a more favorable electrical conductivity than that obtained in Example 1.

For that purpose the final rolling temperature is set at about 550° C. The casting and the rolling until the thirteenth stand 11 are effected in the same way as in the Example 1. From the thirteenth stand 11, the rolled bar 1, which now has a section of 95 $mm^2$, is directed at a speed of 840 meters/min. to the fourteenth stand 12 through two tubular chambers 13 (internal diameter: 30 mm; length; 1m) placed in alignment and coaxially with the path of the bar 1, each chamber 13 having in its middle part a side pipe 14 (internal diameter : 40 mm) through which a rolling emulsion is pumped at a pressure of about 6 atmospheres, thus cooling the bar 1 abruptly to a temperature of 550° C. That abrupt cooling flakes the crust of oxides still present on the surface of the bar 1; the flakes of oxide are removed and leave the plant with the rolling emulsion stream.

The bar thus treated undergoes two more rolling passes 12 and 15. The wire emerging from the rolling mill may be pickled three times faster than a wire obtained by the conventional process, and it has been noted just as in the Example 1 that the cleaning of the bar while it passes through the rolling mill, confers to the final product a much smoother surface and substantially delays the wear of the groovings of the rolls.

What I claim is:

1. In the known process for the direct and continuous manufacture of copper wire rod starting from liquid metal, in which a bar is produced by continuous casting and conveyed while still hot to a rolling mill where the bar is rolled down into a wire rod in a plurality of roll passes, including a few early roll passes and several later roll passes, and in which process a crust of oxide is present on the surface of the rod being rolled down, the improvement which comprises removing the crust of oxide in at least one cleaning operation between the early roll passes by projecting a liquid selected from the group consisting of water and a rolling emulsion under a pressure of between 20 and 60 atmospheres against the periphery of the rod being rolled down, the flow of said liquid under pressure being less than 50 liters/minute per cleaning operation so as to avoid an appreciable cooling of the rod being rolled down between the early roll passes, and after the cleaning operation abruptly cooling the rod being rolled down before one of the later roll passes.

2. A process according to claim 1 in which said liquid is projected as wide flat jets the width of which is directed perpendicular to the longitudinal axis of the rod being rolled down.

3. A process according to claim 2 in which at the side of removal of the rod from the mill, the direction of the projection of the jets forms acute angles with the direction of advancement of the rod being rolled down.

4. A process according to claim 3 in which the acute angles are within the range of between 60° and 80°.

5. A process according to claim 2 in which use is made of two flat jets of liquid, each jet striking a different half of the periphery of the rod being rolled down.

6. A process according to claim 1 in which at least four early passes are used, a cleaning operation being effected between the first and the second pass, between the second and the third pass, and between the third and the fourth pass.

7. A process according to claim 1 in which the abrupt cooling of the rod being rolled down after the cleaning operation is effected by conveying a cooling liquid selected from the group consisting of water and a rolling emulsion under high pressure around and along the rod being rolled down.

8. A process according to claim 7 in which said cooling liquid is conveyed under a pressure higher than 5 atmospheres.

9. A process according to claim 7 in which said cooling liquid is conveyed under a pressure of between 5 and 10 atmospheres.

10. A process according to claim 1 in which said abrupt cooling of the rod being rolled down is carried out immediately before the next-to-last rolling pass.

* * * * *